US006851879B2

(12) United States Patent
Endo

(10) Patent No.: US 6,851,879 B2
(45) Date of Patent: Feb. 8, 2005

(54) IMAGE-RECORDING DEVICE

(75) Inventor: Noboru Endo, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 8 days.

(21) Appl. No.: 10/227,511

(22) Filed: Aug. 26, 2002

(65) Prior Publication Data

US 2003/0103125 A1 Jun. 5, 2003

(30) Foreign Application Priority Data

Nov. 30, 2001 (JP) ..... 2001-367565

(51) Int. Cl.[7] ..... B41J 13/08

(52) U.S. Cl. ..... 400/636.2; 400/575; 400/600; 400/636

(58) Field of Search ..... 400/600.3, 575, 400/636.2, 636, 636.1, 600, 600.2; 347/104

(56) References Cited

U.S. PATENT DOCUMENTS 5,382,104 A * 1/1995 Hirono et al. ..... 400/608.2
5,520,383 A * 5/1996 Amagai et al. ..... 271/265.01
5,980,132 A * 11/1999 Kawai ..... 400/56
6,082,912 A * 7/2000 Shimizu et al. ..... 400/120.01
6,095,699 A * 8/2000 Baumann et al. ..... 400/56
6,113,289 A * 9/2000 Saito et al. ..... 400/58
6,293,670 B1 * 9/2001 Taniguro et al. ..... 347/104
6,550,907 B2 * 4/2003 Uchida ..... 347/104

FOREIGN PATENT DOCUMENTS

JP 2810476 B2 7/1998
JP 11-091177 A 4/1999

* cited by examiner

*Primary Examiner*—Ren Yan
*Assistant Examiner*—Dave A. Ghatt
(74) *Attorney, Agent, or Firm*—Morgan, Lewis & Bockius LLP

(57) ABSTRACT

In an image-recording device of the present invention, driving force of a motor for driving is transmitted to two idle gears, which are the same shape and are disposed at positions of linear symmetry with respect to a center line C. Driving force is transmitted by way of the idle gears to power-input gears which are fixed coaxially with a supply gear and an ejection gear, respectively. That is, a supply side driving force transmission system, ranging from the motor to the supply gear, and a discharge side driving force transmission system, ranging from the motor to the ejection gear, have the same structure. Therefore, a recording sheet will be stably conveyed at the same conveyance speed throughout an image recording region, and high quality image recording can be carried out reliably. Thus, conveyance amounts can be kept consistent in the image recording region, even without using special apparatus, and high quality images can be recorded at low cost.

11 Claims, 8 Drawing Sheets

IMAGE-RECORDING DEVICE

BACKGROUND OF THE INVENTION

1. Field of the Invention

The present invention relates to an image-recording device, and more particularly to an image-recording device that conveys an image recording sheet and performs image recording on a surface of the sheet.

2. Description of the Related Art

Conventionally, in an image-recording device such as, for example, an inkjet recording device, image recording has been carried out by conveying paper for recording (a recording sheet) in a certain direction while discharging ink drops onto the recording paper in accordance with image information. That is, an inkjet recording head is operated to move in a direction intersecting the conveyance direction of the recording paper while discharging the ink drops (main scanning), and is repeatedly reciprocated as the recording paper is conveyed (sub-scanning). Thus, an image is recorded on the recording paper. Accordingly, in order to record images at higher image quality, improvements in accuracy of conveyance of the recording paper are required.

Many ordinary inkjet recording devices and the like have structures in which the recording paper is conveyed by supply rollers, which are disposed at an upstream side of an image recording region, and ejection rollers, which are disposed at a downstream side. In an inkjet recording device having such a structure, in order that the recording paper can be conveyed with high accuracy throughout the entire conveyance direction range of the recording paper, a speed of rotation of the supply rollers is set to a prescribed value corresponding to a conveyance speed of the recording paper. A speed of rotation of the ejection rollers may be set to be slightly faster than the speed of rotation of the supply rollers. In such a constitution, the recording paper is conveyed at a certain conveyance speed by the supply rollers. The ejection rollers rotate so as to slip a little with respect to the recording paper, and the recording paper is stretched between the ejection rollers and the supply rollers while being conveyed. Consequently, a separation between the inkjet recording head and the recording paper is kept stable. Hence, a reduction in image quality that could be caused by variations in this separation can be avoided.

However, in an inkjet recording device having the structure described above, when a back end vicinity portion of the recording paper is released from the supply rollers during the conveyance of the recording paper, the recording paper is subsequently conveyed only by the ejection rollers. Here, because the ejection rollers rotate more quickly than the supply rollers, the conveyance speed of the recording paper becomes larger. Thus, for example, the intervals between the recording lines may become larger and "white ground" portions may result.

As a solution to this kind of problem, Japanese Patent No. 2,810,476, for example, describes a control method for transporting paper in a recording device. A sheet transport speed of a pair of rotating bodies at a recording sheet feed-in side of a printing section is set to V1, a sheet transport speed of a pair of rotating bodies at a recording sheet feed-out side of the printing section is set to V2, and V2>V1. While the sheet is nipped by the rotating body pairs at both the feed-in side and the feed-out side or by only the rotating body pair at the feed-in side, the sheet is transported at the speed V1. But when a rear end of the paper has separated from the rotating body pair at the feed-in side, the sheet transport speed of the rotating body pair at the recording sheet feed-out side is (immediately) adjusted from V2 to V1.

However, to implement this control method, it is necessary to provide, for example, a sensor for detecting when the recording sheet has passed through the rotating body pair at the feed-in side and a pulse generator or the like for efficiently applying input pulses to motors that drive each of the rotating body pairs. Hence, the number of components increases, and this leads to increased costs.

Accordingly, Japanese Patent Application Laid-Open (JP-A) No. 11-91177 describes an image-recording device constituted so as to alter control of image recording when a recording sheet is being conveyed by only one of an upstream side conveying means and a downstream side conveying means. For example, when the recording sheet is being conveyed by only the downstream side conveying means, a recording interval may be reduced. Also, conveyance amounts by the downstream side conveying means are correspondingly reduced. In such a device, control is performed suitably for a front end and a back end of the recording sheet, and thus printing quality is improved.

However, in this structure, when the conveyance amounts of the recording sheet are decreased to such an extent that a deterioration of print quality does not occur, a number of scanning passes by a carriage, to which an inkhead is mounted, is relatively increased by the same proportion. Consequently, when image recording is to be applied to the whole of the recording sheet, recording duration is lengthened.

SUMMARY OF THE INVENTION

In consideration of the above-described situation, an object of the present invention is to provide an image-recording device that can record an image of high image quality by keeping conveyance amounts consistent for the whole of a recording sheet, without causing an increase in costs.

In a first aspect of the present invention, an image-recording device includes: image-recording means capable of recording an image on a recording sheet at an image recording region of the device; a supply roller which supplies the recording sheet to the image recording region; an ejection roller which ejects the recording sheet from the image recording region; a common drive source which applies rotary driving force to the supply roller and the ejection roller; a supply side transmission member for transmitting driving force from the drive source to the supply roller; and an ejection side transmission member for transmitting driving force from the drive source to the ejection roller, wherein the supply side transmission member and the ejection side transmission member each include the same structure.

That is, in this image-recording device, the image-recording means records an image on the recording sheet that has been supplied to the image recording region by the supply roller. Thereafter, the ejection roller ejects the recording sheet from the image recording region.

The supply roller and the ejection roller receive rotary driving force from the shared drive source and are rotated. The supply side transmission member, which transmits driving force from the drive source to the supply roller, and the ejection side transmission member, which transmits driving force from the drive source to the ejection roller, have the same constitution. Consequently, the supply roller and the ejection roller rotate in the same manner, and can convey the recording sheet at the same conveyance speed.

Therefore, the recording sheet is conveyed at a constant speed whether being conveyed by both or by just one of the supply roller and the ejection roller, throughout the entire region of the recording sheet. Thus, images can be recorded at high image quality without the occurrence of "white ground" and the like. Because there is no need to adjust the conveyance speed of the recording sheet, parts and the like for such adjustment are not required. A single drive source can be used and, because the supply side transmission member and the ejection side transmission member have the same constitution, the number of components is not greatly increased, so an increase in costs will not be caused.

Moreover, because the recording sheet is always being conveyed at a constant speed during image recording, the recording duration is not increased when the image is recorded over the whole of the recording sheet. Thus, an image can be recorded onto the whole of the recording sheet in a short time.

Further, because a single drive source can be used, structure can be further simplified.

In a second aspect of the present invention, the supply side transmission member and the ejection side transmission member are respectively structured with gears of the same numbers and same shapes.

The specific constitution of the supply side transmission member and the ejection side transmission member is not particularly limited. However, if the two members are constituted of gears having the same numbers and the same shapes, driving force can be transmitted from the drive source to the supply roller and the ejection roller with high accuracy.

In a third aspect of the present invention, the drive source is disposed such that, viewed from a direction normal to the recording sheet at the image recording region (i.e., in plan view), either the drive source is adjacent to the image recording region or the drive source at least partially overlaps the image recording region.

Accordingly, as viewed from the normal direction of the recording sheet, an amount by which the drive source protrudes relative to the image recording region can be made small (and is preferably eliminated). Therefore, the image recording device can as a whole be made more compact. In view thereof, it is preferable if the drive source is disposed so as to partly overlap with the image recording area, and more preferable if the drive source is disposed so as to completely overlap with the image recording area.

In a fourth aspect of the present invention, the supply roller and the ejection roller are disposed adjacent to the image recording region.

As a result, the image recording device can as a whole be made more compact.

A fifth aspect of the present invention includes a limiting member which is disposed at both of width direction ends of the recording sheet and which limits displacement in a thickness direction of the recording sheet to a certain range.

That is, displacement in the thickness direction of the recording sheet (for example, lifting of the recording sheet or the like) is limited to within the prescribed range by the limiting member. Therefore, a separation distance between the recording sheet and the image recording means can also be limited to a certain range. Consequently, high image quality image recording can be performed.

In the first to fourth aspects described above, the size of the image-recording device and the size of the recording sheet, which is an object of image recording by the image-recording device, are not particularly limited. For example, a relatively compact image-recording device can be provided for "A6" and "postcard size" recording sheets and the like. Also, the kinds of recording sheet on which images can be recorded are not particularly limited. For example, papers such as "high quality paper", resin films such as "OHP sheets", and the like can be used as recording sheets.

In a sixth aspect of the present invention, an image-recording device for recording an image on a recording sheet that is conveyed at an image-recording region includes: a supply roller which supplies the recording sheet to the image recording region; an ejection roller which ejects the recording sheet from the image recording region; a drive source common to the supply roller and the ejection roller, provided between the supply roller and the ejection roller; a first gear provided between the supply roller and the drive source, the first gear transmitting driving force from the drive source to the supply roller; and a second gear provided between the ejection roller and the drive source, the second gear transmitting driving force from the drive source to the ejection roller.

According to a structure based on the sixth aspect, the first and second gears, which are driven by the shared drive source, drive the supply roller and the ejection roller. Therefore, the supply roller and the ejection roller can be reliably rotated at the same angular velocity. Thus, the conveyance speed of the recording sheet is the same at each of the supply roller and the ejection roller. Hence, images can be recorded at high image quality, and the image-recording device can be made significantly compact.

In a seventh aspect of the present invention, the first gear and the second gear each includes a single idle gear, the respective idle gears having the same shape as one another. According to this aspect, the supply roller and the ejection roller can be more reliably driven at the same speed. In particular, control of conveyance of a back end of the recording sheet can be performed simply and reliably.

In an eighth aspect of the present invention, the image-recording device further includes: a platen provided between the supply roller and the ejection roller in correspondence with the image recording region, the recording sheet being conveyed on a platen surface; a carriage which is movable in a main scanning direction which intersects a direction of conveyance of the recording sheet; and a recording head which records images, and is provided at the carriage and facing the image recording region.

In a ninth aspect of the present invention, the first and second gears and the drive source are provided adjacent to the platen at a rear surface side of the platen, which rear surface is an opposite side of the platen from the platen surface.

In a tenth aspect of the present invention, a guide which prevents lifting in a thickness direction of the recording sheet is provided at both of recording sheet width direction ends of the platen. In a structure based on this aspect, conveyance of the recording sheet can be controlled more reliably.

In an eleventh aspect of the present invention, the guide has a shape which not only controls lifting of the recording sheet in the thickness direction thereof but also limits movement of the recording sheet in a width direction thereof.

DESCRIPTION OF THE PREFERRED EMBODIMENTS

Figure 1:
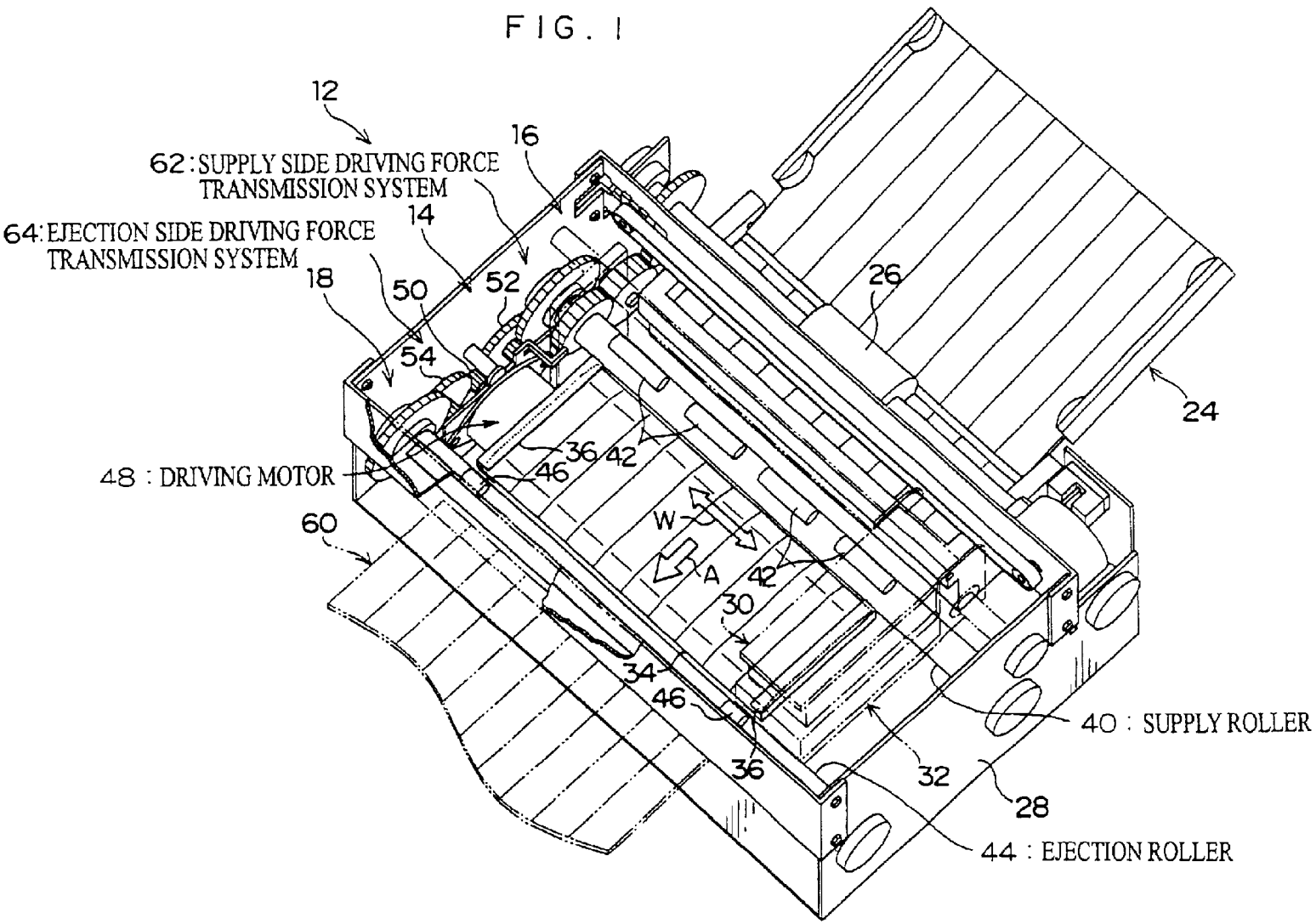
FIG. 1 is a perspective view showing an image-recording device of a first aspect of the present invention.
Figure 2:
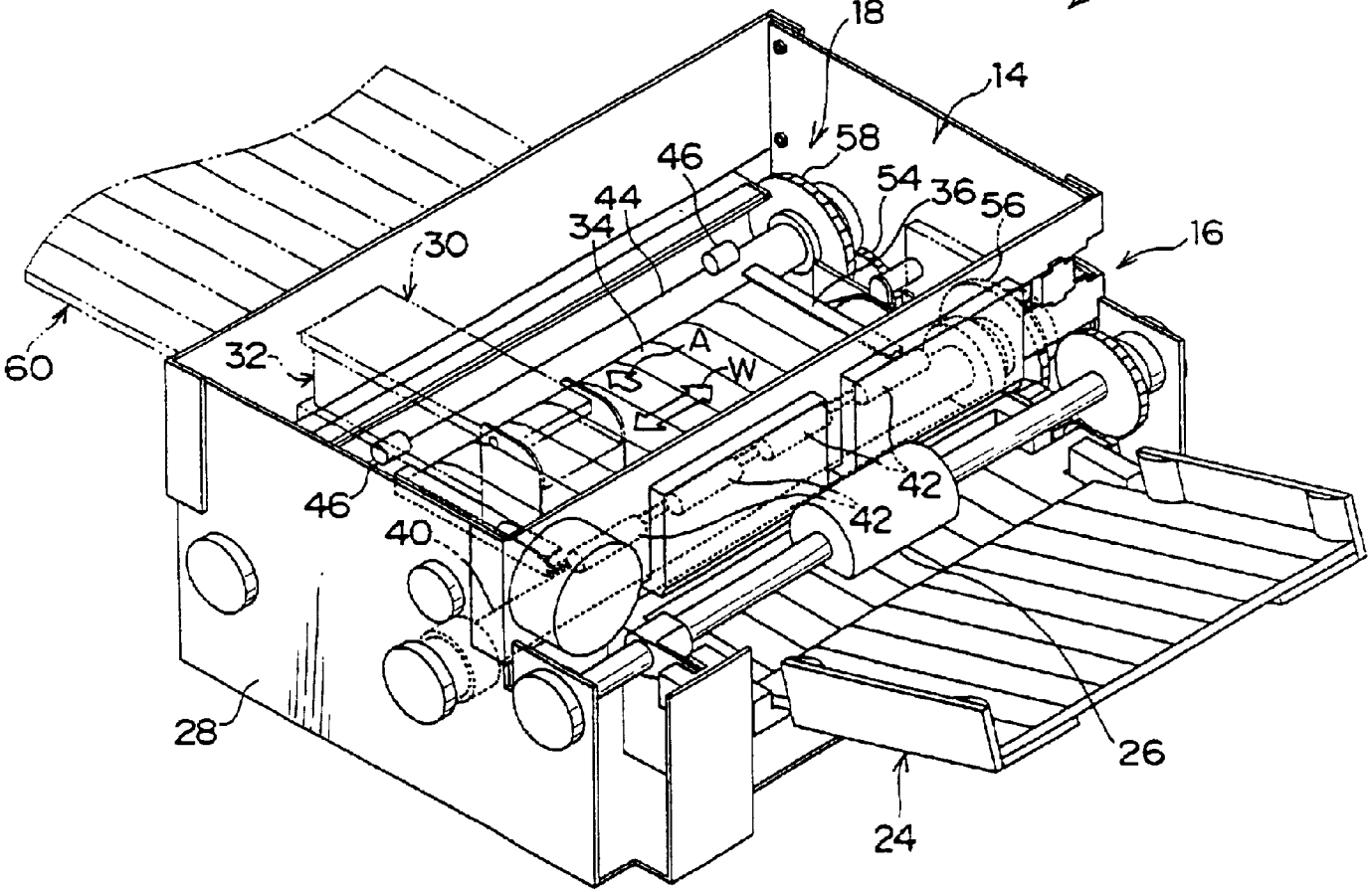
FIG. 2 is a perspective view showing the image-recording device of the first aspect of the present invention.
Figure 3:
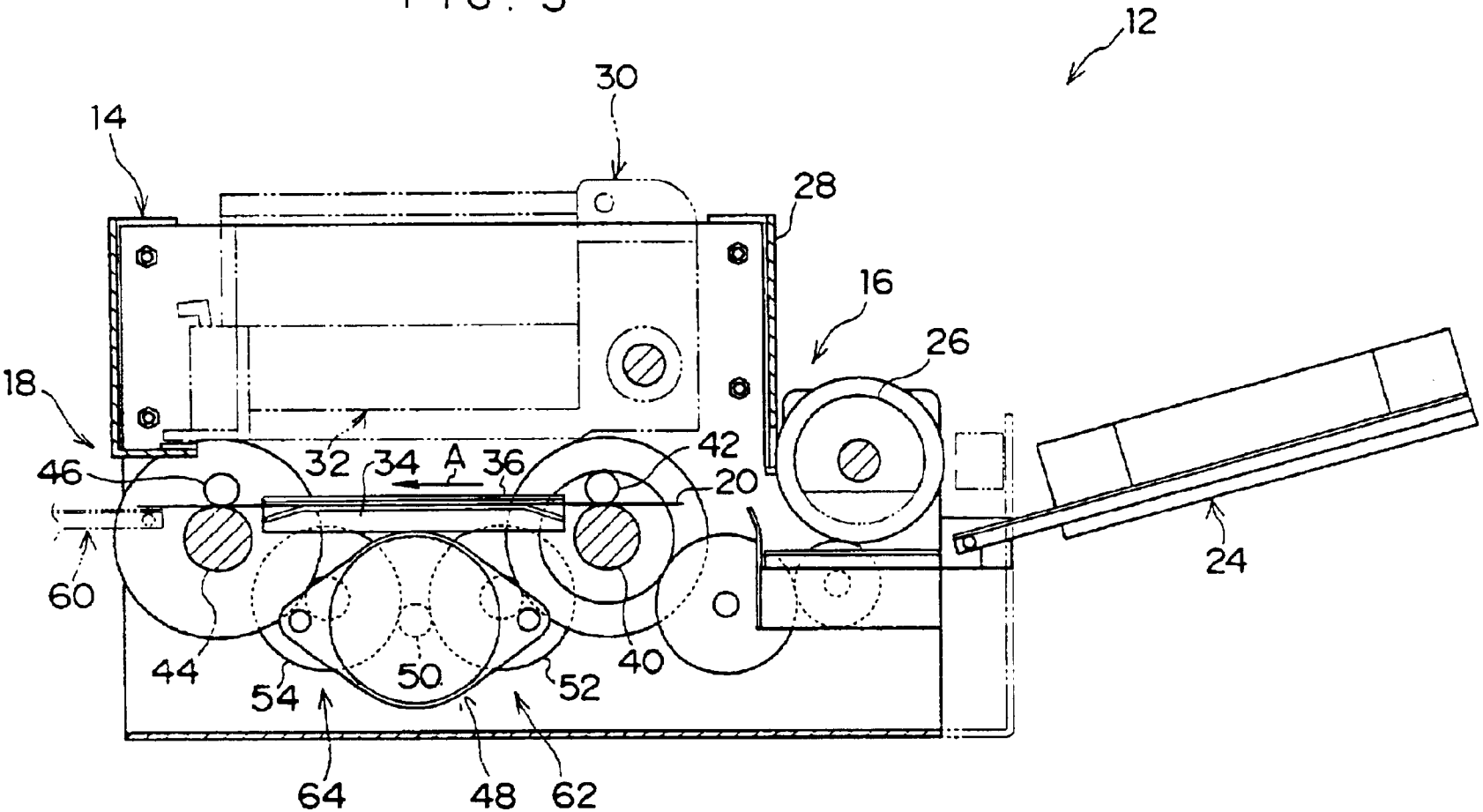
FIG. 3 is a sectional view showing the image-recording device of the first aspect of the present invention.

FIGS. 1 to 4 show an inkjet recording device 12, which is an image-recording device of a first embodiment of the present invention.

The inkjet recording device 12 includes an image-recording main body 14, a recording sheet supply apparatus 16 and a recording sheet ejection apparatus 18. The image-recording main body 14 is capable of recording images on sheets for recording 20 (see FIGS. 3, 5 and 6), at a predetermined recording region 22 (shown in FIG. 4). The recording sheet supply apparatus 16 supplies the recording sheets 20 to the recording region 22, and the recording sheet ejection apparatus 18 discharges the recording sheets 20 from the recording region 22.

The inkjet recording device 12 further includes a supply tray 24, at which the recording sheets 20 can be stacked in a thickness direction thereof. A topmost one of the recording sheets 20 stacked at the supply tray 24 is conveyed in the direction of arrow A by a pickup roller 26 and moved toward the recording region 22. Hereinafter, the term "conveyance direction" represents the conveyance direction of the recording sheet 20, as shown by the arrow A in the drawings. Further, the term "width direction" represents a width direction of the recording sheet 20 intersecting the conveyance direction, as shown by arrow W in the drawings.

The image-recording main body 14 includes a frame member 28, which is shaped substantially like a frame. A carriage 30 is attached to the frame member 28 so as to be movable in the width direction. An inkjet recording head 32 is mounted to the carriage 30 and fixed at a predetermined attachment position. An ink discharge port of the inkjet recording head 32 opposes a surface of the recording sheet 20 in the recording region 22. The inkjet recording head 32 discharges ink drops in accordance with image information while moving in the width direction of the recording sheet 20 (the direction of the arrow W) integrally with the carriage 30. Thus, "main scanning" is carried out.

A platen 34 is fixed at a position corresponding to the recording region 22 (a region through which an ink discharge area moves, which depends on a main scanning range of the inkjet recording head 32). The recording sheet 20 is disposed on the platen 34, and thus a lower surface (rear surface) of the recording sheet 20 is supported.

Figure 6:
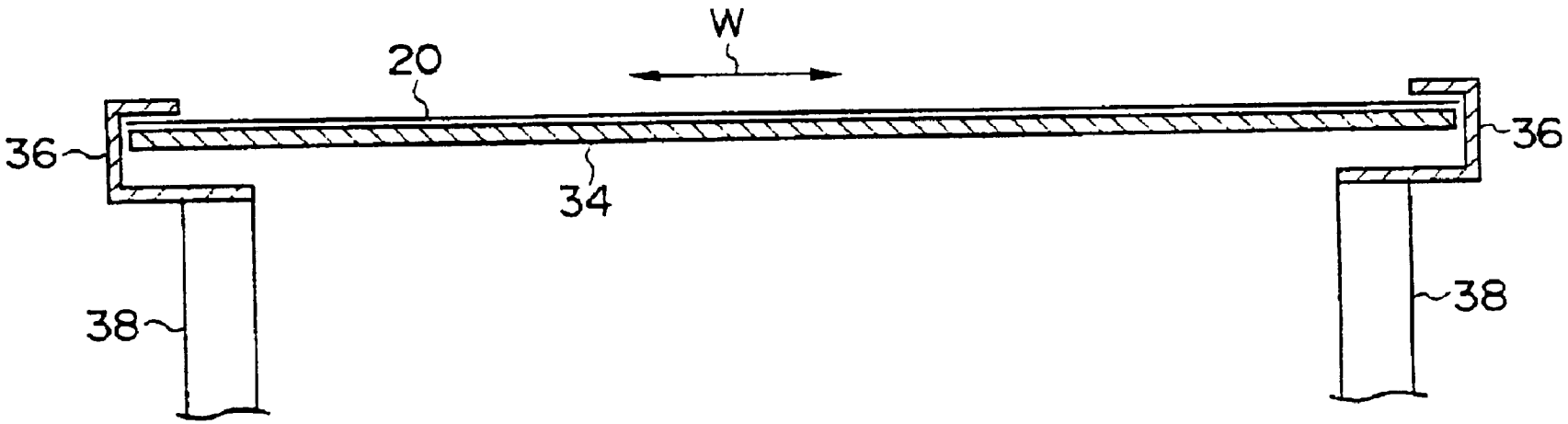
FIG. 6 is a schematic sectional view showing a recording region of the image-recording device of the first aspect of the present invention, cut along a transverse direction.

As shown in detail in FIG. 6, lifting prevention guides 36 are attached to the frame member 28 via attachment members 38. The lifting prevention guides 36 encompass both of width direction sides of the platen 34, and oppose an upper side and both of width direction end portion sides of the recording sheet 20. Consequently, movement in the thickness direction of the recording sheet 20 (a vertical direction) is limited by the platen 34 and the lifting prevention guides 36, and flatness of the recording sheet 20 during image recording is assured. Also, movement in the width direction of the recording sheet 20 is limited by the lifting prevention guides 36. Consequently, it is to be expected that the attitude of the recording sheet 20 in the recording region 22 will be stable.

In particular, in an inkjet-type image-recording device, such as that of the present embodiment, which performs image recording by adhering ink drops to the recording sheet 20, there is a possibility that lifting of the recording sheet 20 at the platen 34 could become significant, causing a deterioration of image quality. This can be caused due to such factors as the type of the recording sheet 20, the environment during printing, and the amounts of ink being adhered. Therefore, it is preferable that the attitude of the recording sheet 20 be stabilized as in the present embodiment, at least at the recording region 22.

A supply roller 40 is disposed at an upstream side of the platen 34, adjacent to the recording region 22 and suspended along the frame member 28. An unillustrated shaft is disposed upward of the supply roller 40, and a facing supply roller 42 is attached at this shaft.

The supply roller 40 is formed to be longer than the width of the recording sheet 20. The supply roller 40 contacts the recording sheet 20 from the lower surface side thereof. A plurality of the facing supply roller 42 (four in the present embodiment) are disposed along the supply roller 40 in the width direction. The facing supply rollers 42 contact the recording sheet 20 from the upper surface side thereof. The recording sheet 20 is nipped by the supply roller 40 and the facing supply rollers 42. Thus, in this nipped state, when the supply roller 40 rotates, the recording sheet 20 is conveyed and is supplied to the recording region 22.

An ejection roller 44 is disposed at a downstream side of the platen 34, adjacent to the recording region 22 and suspended along the frame member 28. An unillustrated shaft is disposed upward of the ejection roller 44, and facing ejection rollers 46 are attached at this shaft.

Similarly to the supply roller 40, the ejection roller 44 is formed to be longer than the width of the recording sheet 20. The ejection roller 44 contacts the recording sheet 20 from the lower surface side thereof. The facing ejection rollers 46 are disposed at each of width direction end portions of the recording sheet 20. The facing ejection rollers 46 contact the recording sheet 20 from the upper surface side thereof. The recording sheet 20 is nipped by the ejection roller 44 and the facing ejection rollers 46. In this nipped state, when the ejection roller 44 rotates, the recording sheet 20 is conveyed and is ejected from the recording region 22. The facing ejection rollers 46 contact both of end vicinity portions, in the width direction, of the recording sheet 20, that is, portions for which it has been specified in advance that ink will not be adhered by the inkjet recording head 32 during image recording. Accordingly, the transfer of ink which has not been dried to the facing ejection rollers 46 and re-transfer of this ink back to the recording sheet 20, which would cause a reduction in image quality, does not occur.

Figure 5:
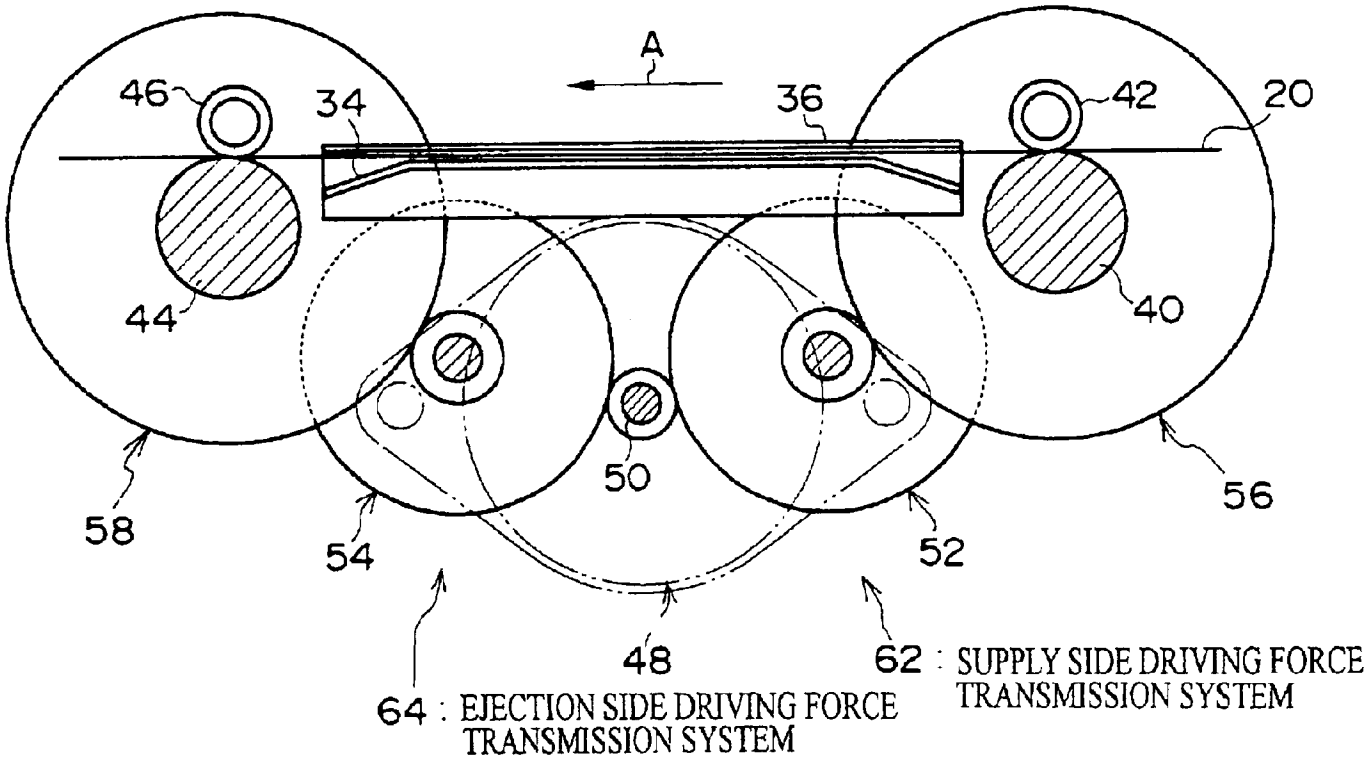
FIG. 5 is an enlarged, explanatory view of a supply side transmission member and an ejection side transmission member of the image-recording device of the first aspect of the present invention.

As shown in detail in FIG. 5, a driving motor 48 is disposed between the supply roller 40 and the ejection roller 44. Driving force of the driving motor 48 is transmitted from an output gear 50 of the driving motor 48 to two idle gears 52 and 54. Input gears 56 and 58 are coaxially fixed with the supply roller 40 and the ejection roller 44, respectively. The driving force is transmitted from the idle gears 52 and 54 to the input gears 56 and 58. Thus, the supply roller 40 and the ejection roller 44 are rotated.

The idle gears 52 and 54 have the same shapes as one another, and are disposed at positions which are symmetrical about a center line C, which passes through the center of the output gear 50 of the driving motor 48. Moreover, because the input gear 56 of the supply roller 40 and the input gear 58 of the ejection roller 44 have the same shapes as one another and are disposed at positions which are symmetrical about the center line C, a supply side driving force transmission system 62, from the driving motor 48 to the supply roller 40, and an ejection side driving force transmission system 64, from the driving motor 48 to the ejection roller 44, are structured by the same number of gears, with the same shapes at the corresponding positions. Thus the supply side driving force transmission system 62 and the ejection side driving force transmission system 64 have completely the same structure as one another.

Figure 4:
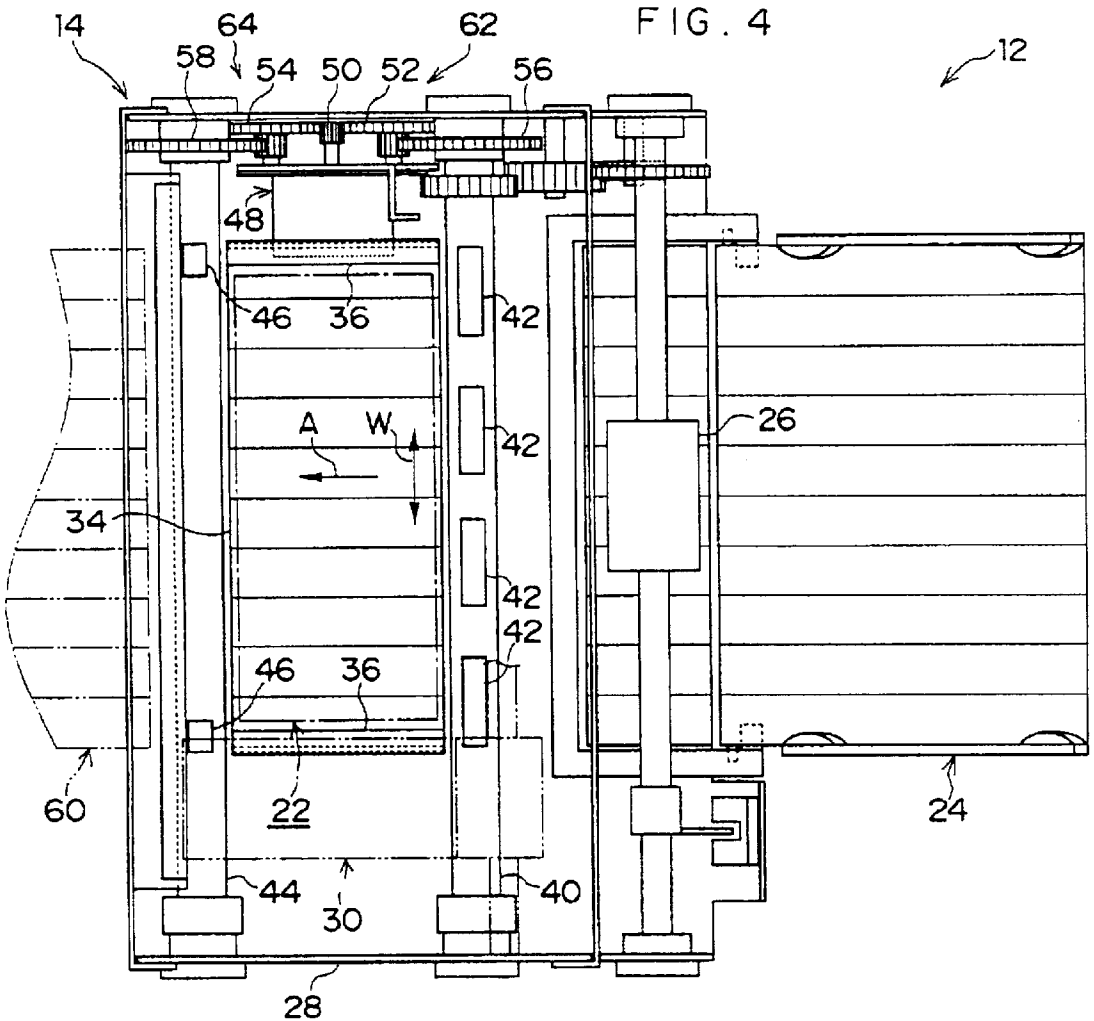
FIG. 4 is a plan view showing the image-recording device of the first aspect of the present invention.

As can be seen in FIG. 4, when the inkjet recording device 12 is observed in plan view, the driving motor 48 is seen to be disposed at a position adjacent to the recording region 22 (or, more strictly, at a partly overlapping position). Therefore, it can be expected that the inkjet recording device 12 will as a whole be more compact than in a case of the driving motor 48 being disposed at a position apart from the recording region 22. In view of this point, it is preferable that the driving motor 48 is disposed so as to partially overlap the recording region 22 in plan view, rather than simply being disposed adjacent to the recording region 22, and it is more preferable that the driving motor 48 is disposed so as to completely overlap the recording region 22.

In the inkjet recording device 12 of the present embodiment, the supply roller 40 and the ejection roller 44 each includes a stiff outer peripheral surface formed as a column or hollow cylinder. Surface treatment is applied thereto such that the outer peripheral surface can exhibit a predetermined frictional force with respect to the recording sheet 20. Thus, the supply roller 40 and the ejection roller 44 are surface-machined rigid rollers. As a result, because a rigid body can be used as a base material of the roller, diametric accuracy and a run-out tolerance dimension are excellent compared to rubber rollers made of EPDM materials and the like, which are commonly used for conveyance of recording sheets. Also, environmental variations of the diameter are extremely small and dimensional stability is excellent.

Further, because, due to the surface treatment, the surface exhibits a predetermined frictional force with respect to the recording sheet 20, the supply roller 40 and the ejection roller 44 will not slip with respect to the recording sheet 20 during conveyance of the recording sheet 20, and conveyance can be performed with high accuracy.

As long as the above conditions are satisfied, the specific constitutions of the supply roller 40 and the ejection roller 44 are not particularly limited. For example, a metal may be used as the rigid body, and the surface of this metallic base material may be coated with ceramic or urethane. Such a roller is preferable, in that it has precise dimensions, diametric stability with respect to environmental changes, and stability in coefficient of friction.

The facing supply roller 42 and the facing ejection rollers 46 should nip the recording sheet 20 against the supply roller 40 and the ejection roller 44, respectively, with nipping forces that are suitable for reliably conveying the recording sheet 20. Also, the facing supply roller 42 and the facing ejection rollers 46 should not cause damage or the like to the surfaces of the supply roller 40 and the ejection roller 44 by local concentrations of pressure. Thus, the facing supply roller 42 and the facing ejection rollers 46 should have appropriate resiliency. As long as these conditions are satisfied, materials of the facing supply roller 42 and the facing ejection rollers 46 are not particularly limited. In the present embodiment the facing supply roller 42 and the facing ejection rollers 46 are formed of fluorine-containing elastomers, in view of assuring high reliability.

A discharge tray 60 is attached at a conveyance direction downstream side of the image-recording main body 14. Recording sheets 20 on which images have been recorded are ejected to the discharge tray 60.

Parameters of the above-described members for conveying the recording sheet 20 are decided in accordance with various conditions such as the number of recording sheets 20 in a stack as determined by specifications of the inkjet recording device 12, types of the recording sheets 20, anticipated environments (temperature and humidity) and the like, so that the conveyance performance of the members is affected as least as possible by change/variations of such conditions.

Now, operation of the inkjet recording device 12 of the present embodiment will be described.

The topmost of the recording sheets 20 stacked on the supply tray 24 is conveyed in the direction of the arrow A by the pickup roller 26. Then, the recording sheet 20 is nipped by the supply roller 40 and the facing supply roller 42, from the front end side of the recording sheet 20, and the recording sheet 20 is conveyed further by rotation of the supply roller 40.

When the recording sheet 20 reaches the recording region 22, conveyance of the recording sheet 20 is temporarily halted. Then, the carriage 30 moves in the width direction (the direction of the arrow W) and, at the same time, the inkjet recording head 32 discharges ink drops to the upper surface of the recording sheet 20 from the unillustrated ink discharge port in accordance with image information. Thus, main scanning is carried out. When main scanning has been completed for one line, the supply roller 40 rotates such that the recording sheet 20 is conveyed by an amount of precisely one line width (a distance in the conveyance direction). Hence, the recording sheet 20 is conveyed and sub-scanning is carried out.

In this manner, main scanning and sub-scanning are alternately repeated, and a desired image is recorded on the upper surface of the recording sheet 20.

During image recording (or, depending on the relation between the size of the image and the size of the recording sheet 20, after image recording has finished), the recording sheet 20 is nipped by the ejection roller 44 and the facing ejection rollers 46, from the front end side of the recording sheet 20, and the recording sheet 20 is conveyed further by rotation of the ejection roller 44. That is, the recording sheet 20 will be nipped at both the front end side and rear end side thereof, as shown in FIG. 5, until a portion nipped by the supply roller 40 and the facing supply roller 42 at the rear end of the recording sheet 20 is released.

Then, when the portion nipped by the supply roller 40 and the facing supply roller 42 at the rear end of the recording sheet 20 has been released, the recording sheet 20 is nipped and conveyed only by the ejection roller 44 and the facing ejection rollers 46. While the image is being recorded on the recording sheet 20, the ejection roller 44 repeatedly halts and rotates in accordance with single line widths (the distance in the conveyance direction), in the same manner as the supply roller 40. When image recording has finished, the ejection roller 44 rotates continuously and the recording sheet 20 is ejected in a short time.

Here, in the inkjet recording device 12 of the present embodiment, the supply side driving force transmission system 62, from the driving motor 48 to the supply roller 40, and the ejection side driving force transmission system 64, from the driving motor 48 to the ejection roller 44, have the same structure as one another. Resultantly, the supply roller 40 and the ejection roller 44 rotate at the same angular velocity as one another, and have the same conveyance speed with respect to the recording sheet 20. Therefore, the recording sheet 20 is stably conveyed at the same speed regardless of whether the recording sheet 20 is being conveyed by conveyance force from one of the supply roller 40 and the ejection roller 44 or from both of the supply roller 40 and the ejection roller 44, for the whole area of the recording sheet 20. Thus, a high quality image can be recorded without the occurrence of "white ground" or the like. There is no need, as in the conventional art, for ejection side rollers to have a higher rotation speed or for the rotation speed of these rollers to be controlled in accordance with position of the recording sheet 20. Moreover, because the single driving motor 48 is used and the supply side driving force transmission system 62 and the ejection side driving force transmission system 64 have structures in common, the inkjet recording device 12 can be structured at low cost.

Further, in the inkjet recording device 12 of the present embodiment, movement in the thickness direction (a vertical direction) of the recording sheet 20 is limited by the lifting prevention guides 36. Thus, flatness of the recording sheet 20 during image recording is assured. As a result, because the separation between the ink discharge port of the inkjet recording head 32 and the recording sheet 20 can be kept constant, high quality images can be recorded.

A structure for the supply roller 40 and the ejection roller 44 to be rotated at the same speed by driving force from the driving motor 48 is not limited to the structure described above. For example, a structure shown in FIG. 7, a structure shown in FIG. 8, or the like can be used. With these structures, the overall constitution of the inkjet recording device is the same as above, so descriptions thereof can be omitted. Structural elements, components and the like that are the same as for the first embodiment are given the same reference numbers and need not be described further.

Figure 7:
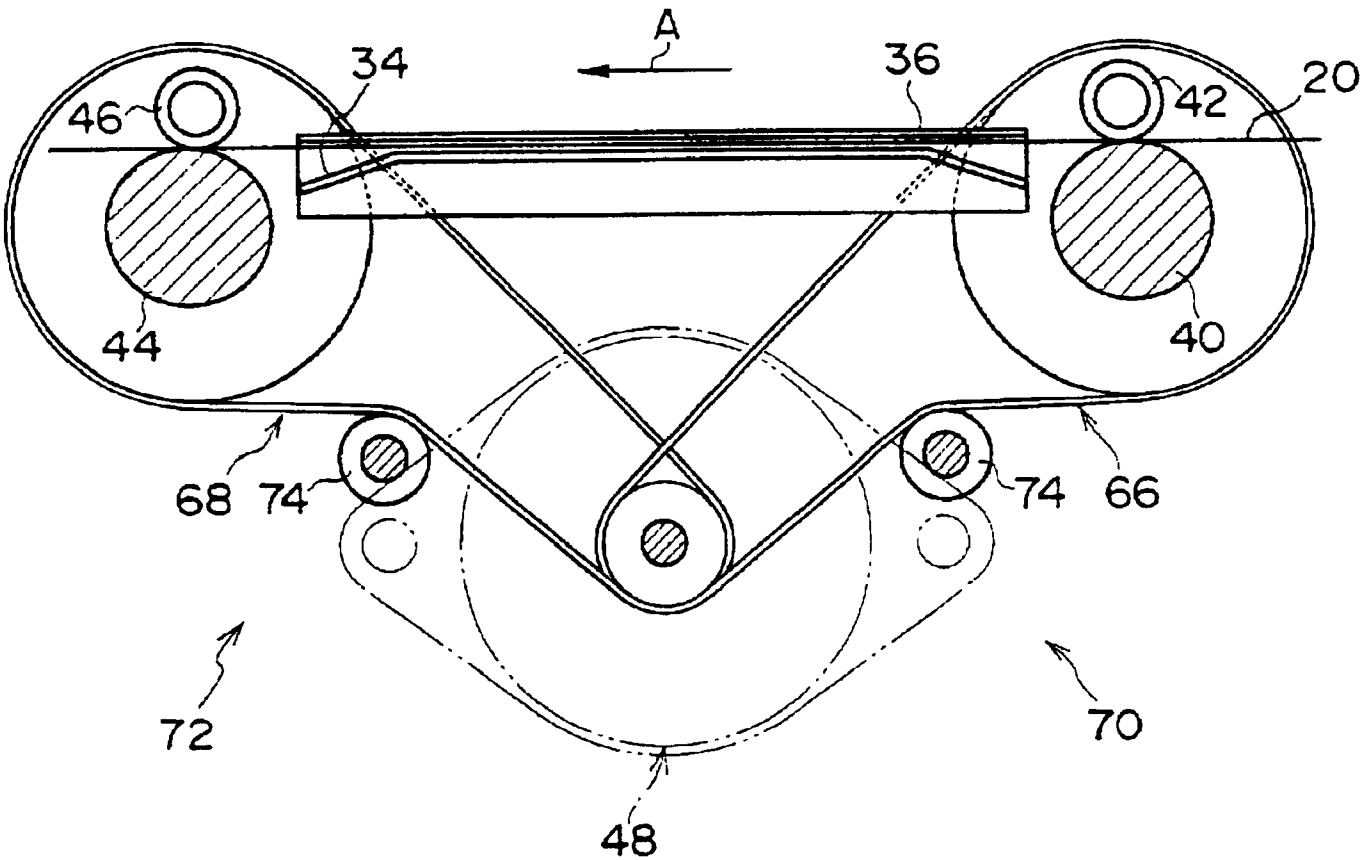
FIG. 7 is an enlarged, explanatory view of a supply side transmission member and an ejection side transmission member of an image-recording device of a second aspect of the present invention.

An inkjet recording device of a second embodiment, shown in FIG. 7 (the whole body is not shown), uses endless-type toothed belts 66 and 68 instead of the idle gears 52 and 54. The endless toothed belts 66 and 68 structure a supply side driving force transmission system 70 and an ejection side driving force transmission system 72, respectively. Specifically, the endless toothed belt 66 winds around the output gear 50 and the input gear 56, and the endless toothed belt 68 winds around the output gear 50 and the input gear 58.

Accordingly, in the inkjet recording device of the second embodiment, the supply roller 40 and the ejection roller 44 rotate at the same angular velocity as one another and have the same conveyance speed with respect to the recording sheet 20. As above, the recording sheet 20 can be stably conveyed at the same speed regardless of whether the recording sheet 20 is being conveyed by conveyance force from the supply roller 40 or the ejection roller 44, and a high quality image can be recorded. Also, because the supply side driving force transmission system 70 and the ejection side driving force transmission system 72 have structures in common, the inkjet recording device can be structured at low cost.

It is preferable that tension rollers 74 are provided so as to constantly apply a predetermined tension to the endless toothed belts 66 and 68. However, the tension rollers 74 may be omitted, and the structure thus simplified, as long as the predetermined tension is applied to the endless toothed belts 66 and 68.

Figure 8:
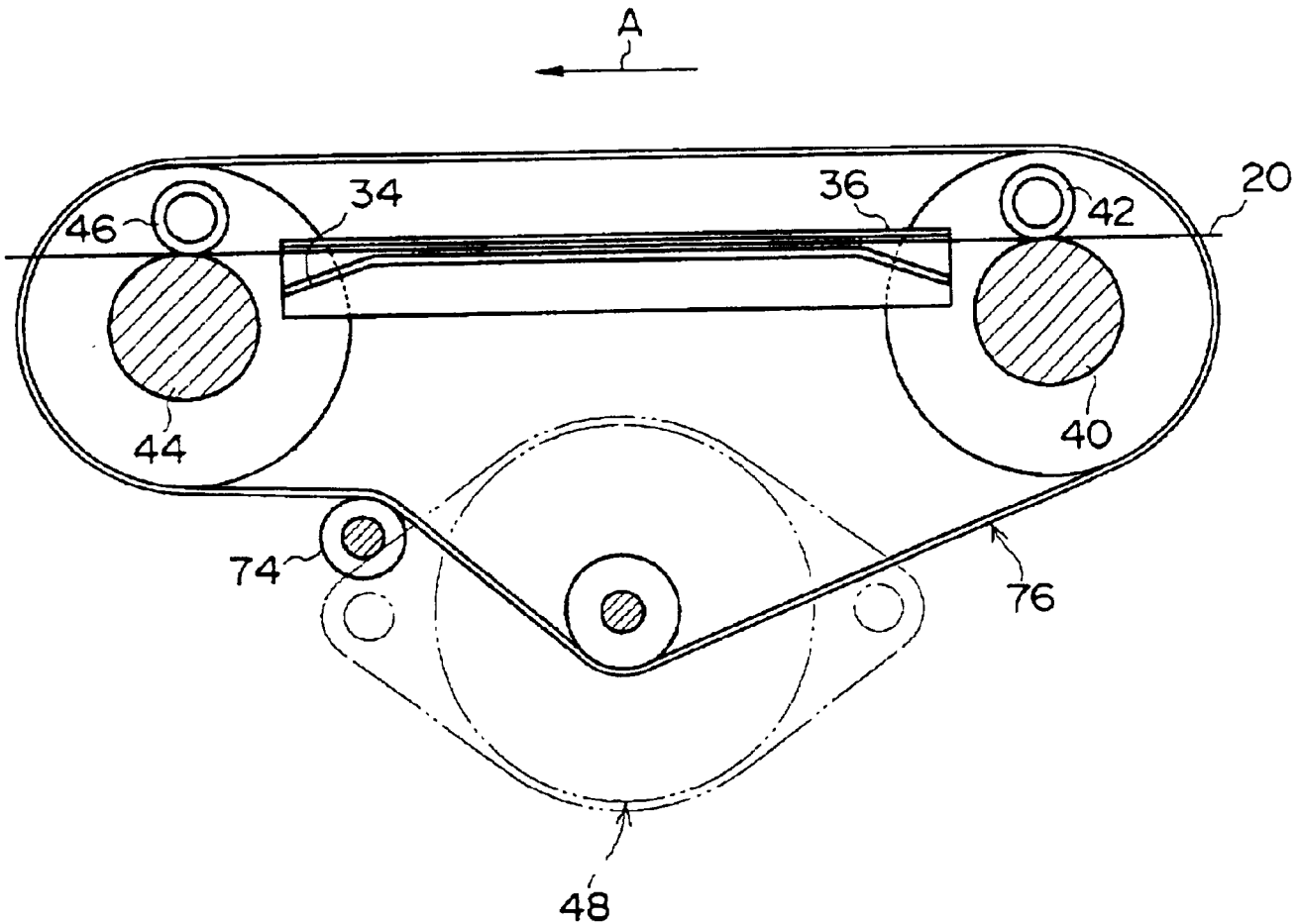
FIG. 8 is an enlarged, explanatory view of a supply side transmission member and an ejection side transmission member of an image-recording device of a third aspect of the present invention.

In an inkjet recording device of a third embodiment, shown in FIG. 8, an endless driving belt 76 is wound around three gears, the output gear 50, the input gear 56 and the input gear 58. This embodiment is substantially a case in which the endless toothed belts 66 and 68 of the second embodiment are combined to one belt and the single belt is used for both the supply side and the ejection side. Consequently, the number of components can be further decreased, and the inkjet recording device can be constructed at even lower cost.

Thus, various structures can be employed for transmitting driving force of the driving motor 48 to the supply roller 40 and the ejection roller 44. Because the second embodiment and the third embodiment do not use the idle gears 52 and 54 of the first embodiment, members that support the idle gears 52 and 54 can be omitted, and the structure made simpler. On the other hand, if the idle gears 52 and 54 are used, as in the first embodiment, driving force can be transmitted with a higher accuracy than when endless toothed belts are used as in the second embodiment and third embodiment.

Also, although the positions of the supply roller 40 and the ejection roller 44 are not particularly limited as long as the recording sheet 20 is reliably conveyed, by disposing the supply roller 40 and the ejection roller 44 adjacent to the recording region 22, it can be expected that the inkjet recording device 12 will as a whole be more compact.

Size and the like of the recording sheet 20, which is the object of image recording, are not particularly limited for any of the inkjet recording devices of these embodiments. However, bearing in mind that the facing ejection rollers 46 nip the recording sheet 20 only at both end vicinity portions in the width direction thereof, if the object of recording is, for example, A6 size or postcard size, the object of recording is preferably conveyed with a short side direction thereof set along the width direction. This is preferable because lifting of the recording sheet at a width direction central portion thereof can be more reliably prevented.

The embodiments described above are examples of image-recording devices of the present invention. Examples of inkjet recording devices that record images on recording sheets (recording paper) by inkjet methods have been explained. Image-recording devices of the present invention are not limited to devices that use such inkjet methods. For example, the present invention may also be applied to devices that use electrophotographic methods. In such a case, a structure applicable to electrophotography may be employed for the main body of the recording device.

To summarize, with the present invention, conveyance amounts are consistently maintained throughout the whole area of a recording sheet by the constitutions described above. Thus, images of high image quality can be recorded without incurring an increase in costs.

What is claimed is:

1. An image-recording device comprising:

image-recording means capable of recording an image on a recording sheet at an image recording region of the device;

a supply roller which supplies the recording sheet to the image recording region;

an ejection roller which ejects the recording sheet from the image recording region;

a common drive source which applies rotary driving force to the supply roller and the ejection roller, the supply roller and the ejection roller being rotated at substantially the same angular velocity as one another by the common drive source, and having substantially the same conveyance speed with respect to the recording sheet;

a supply side transmission member for transmitting driving force from the drive source to the supply roller; and an ejection side transmission member for transmitting driving force from the drive source to the ejection roller, wherein the supply side transmission member and the ejection side transmission member each include the same structure.

2. The image-recording device of claim 1, wherein the supply side transmission member and the ejection side transmission member are respectively structured with gears of the same numbers and same shapes.

3. The image-recording device of claim 1, wherein the drive source is disposed such that, viewed from a direction normal to the recording sheet at the image recording region, either the drive source is adjacent to the image recording region or the drive source at least partially overlaps the image recording region.

4. The image-recording device of claim 1, wherein the supply roller and the ejection roller are disposed adjacent to the image recording region.

5. The image-recording device of claim 1, further comprising limiting members disposed at both of width direction ends of the recording sheet, the limiting members limiting displacement in a thickness direction of the recording sheet to a certain range.

6. An image-recording device for recording an image on a recording sheet that is conveyed at an image-recording region, the device comprising:

a supply roller which supplies the recording sheet to the image recording region;

an ejection roller which ejects the recording sheet from the image recording region;

a drive source common to the supply roller and the ejection roller, provided between the supply roller and the ejection roller, the supply roller and the ejection roller being rotated at substantially the same angular velocity as one another by the common drive source, and having substantially the same conveyance speed with respect to the recording sheet;

a first gear provided between the supply roller and the drive source, the first gear transmitting driving force from the drive source to the supply roller; and a second gear provided between the ejection roller and the drive source, the second gear transmitting driving force from the drive source to the ejection roller, wherein the first gear and the second gear each include the same structure.

7. The image-recording device of claim 6, wherein each of the first gear and the second gear comprises a single idle gear, the respective idle gears having the same shape as one another.

8. The image-recording device of claim 6, further comprising:

a platen provided between the supply roller and the ejection roller in correspondence with the image recording region, the recording sheet being conveyed on a surface of the platen;

a carriage which is movable in a main scanning direction which intersects a direction of conveyance of the recording sheet; and a recording head which records images, and is provided at the carriage and facing the image recording region.

9. The image-recording device of claim 8, wherein the first and second gears and the drive source are provided adjacent to the platen at a rear surface side of the platen, which rear surface is an opposite side of the platen from the platen surface on which the recording sheet is conveyed.

10. The image-recording device of claim 8, further comprising guides which prevent lifting in a thickness direction of the recording sheet, the guides being provided at both of recording sheet width direction ends of the platen.

11. The image-recording device of claim 10, wherein the guides control lifting in the thickness direction of the recording sheet and limit movement in a width direction of the recording sheet.

* * * * *